US012704250B2

(12) United States Patent
Tyler et al.

(10) Patent No.: US 12,704,250 B2
(45) Date of Patent: Aug. 11, 2026

(54) FIRE WATER PLANT I

(71) Applicant: Erthos IP LLC, Tempe, AZ (US)

(72) Inventors: James S Tyler, Tempe, AZ (US); Joseph Halligan, Rancho Cordova, CA (US); Chris Hall, Rancho Cordova, CA (US); Tony Guana, Rancho Cordova, CA (US)

( * ) Notice: Subject to any disclaimer, the term of this patent is extended or adjusted under 35 U.S.C. 154(b) by 418 days.

(21) Appl. No.: 18/193,057

(22) Filed: Mar. 30, 2023

(65) Prior Publication Data

US 2024/0210028 A1 Jun. 27, 2024

Related U.S. Application Data

(63) Continuation-in-part of application No. 17/820,222, filed on Aug. 16, 2022, now abandoned.

(51) Int. Cl.

| | |
|---|---|
| ***F22B 9/00*** | (2006.01) |
| ***F22B 1/00*** | (2006.01) |
| ***F22B 1/26*** | (2006.01) |

(52) U.S. Cl.

CPC ..... *F22B 1/26* (2013.01); *F22B 1/003* (2013.01)

(58) Field of Classification Search

CPC .... F22B 1/26; F22B 1/003; F22B 1/00; F22B 1/284; F22B 9/00; F22B 35/104; F22B 37/261; F22G 5/12

See application file for complete search history.

(56) References Cited

U.S. PATENT DOCUMENTS

| | | | | |
|---|---|---|---|---|
| 1,201,481 | A | 10/1916 | McGail et al. | |
| 3,279,949 | A | 10/1966 | Schaefer et al. | |
| 3,365,068 | A | 1/1968 | Crosby | |
| 3,395,232 | A | 7/1968 | White | |
| 3,415,687 | A | 12/1968 | Methlie, II | |
| 3,515,102 | A * | 6/1970 | Hamilton, Jr. | F22G 5/12 122/487 |
| 4,018,508 | A | 4/1977 | McDermott et al. | |
| 4,207,097 | A | 6/1980 | Fukuda et al. | |
| 4,258,110 | A | 3/1981 | Alvarez et al. | |
| 4,262,068 | A | 4/1981 | Kono et al. | |
| 4,341,607 | A | 7/1982 | Tison | |
| 4,379,043 | A | 4/1983 | Chappelle | |

(Continued)

FOREIGN PATENT DOCUMENTS

| | | | |
|---|---|---|---|
| CN | 2535552 Y | * | 2/2003 |
| CN | 206338933 U | * | 7/2017 |

(Continued)

*Primary Examiner* — Gregory A Wilson

(74) *Attorney, Agent, or Firm* — Galvani Smith PLLC; Thomas W. Galvani; Rowan P. Smith

(57) ABSTRACT

Hydrogen boilers with no measurable NOx emissions. In some versions the fuel is a ratio of already mixed hydrogen and oxygen, ratio of pre-mixed hydrogen and oxygen, or the fuel comprises hydrogen and the burner also contains a separate nozzle for introducing a ratio of oxygen. In some versions, these ratios are stoichiometric between hydrogen oxygen. Some versions show burner systems that monitor the combustion process, which is a condensing process, and have hydrogen oxygen pilots and ultraviolet flame detectors. These hydrogen boilers can supply all the process steam needed by a system or can supply part of the process steam needed by a system.

16 Claims, 6 Drawing Sheets

(56) References Cited

U.S. PATENT DOCUMENTS 4,410,606 A 10/1983 Loutfy et al.
4,505,997 A 3/1985 Armand
4,597,363 A 7/1986 Emelock
4,627,388 A * 12/1986 Buice ..... F22B 7/12 588/900
4,786,567 A 11/1988 Skyllas-Kazacos et al.
4,810,595 A 3/1989 Kahara et al.
5,021,308 A 6/1991 Armand
5,037,510 A * 8/1991 Nygards ..... C02F 1/04 122/18.31
5,273,840 A 12/1993 Ney
5,314,590 A 5/1994 Kamiya et al.
5,352,547 A 10/1994 Kita et al.
5,389,467 A 2/1995 Heir et al.
5,468,466 A 11/1995 Bacon et al.
5,514,493 A 5/1996 Waddel et al.
5,534,370 A 7/1996 Kita et al.
5,538,812 A 7/1996 Lee et al.
5,599,438 A 2/1997 Shiramizu et al.
5,843,297 A 12/1998 Schmid et al.
5,916,475 A 6/1999 Midiot et al.
6,063,552 A 5/2000 Bourdelais et al.
6,120,696 A 9/2000 Armand et al.
6,143,443 A 11/2000 Kazacos et al.
6,171,522 B1 1/2001 Michot et al.
6,203,949 B1 3/2001 Ehrlich
6,228,942 B1 5/2001 Michot et al.
6,280,883 B1 8/2001 Lamanna et al.
6,365,301 B1 4/2002 Michot et al.
6,423,454 B1 7/2002 Heider et al.
6,441,216 B1 8/2002 Leonov et al.
6,562,514 B1 5/2003 Kazacos et al.
6,576,159 B1 6/2003 Michot et al.
6,620,546 B1 9/2003 Michot et al.
6,841,304 B2 1/2005 Michot et al.
6,864,017 B2 3/2005 Leonov et al.
6,911,595 B2 6/2005 Yoshikawa et al.
6,986,970 B1 1/2006 Kumar et al.
7,471,502 B2 12/2008 Sato et al.
8,163,158 B2 4/2012 Newkirk
8,329,344 B2 12/2012 Koh et al.
11,662,120 B2 * 5/2023 Zala ..... F24H 9/0084 122/18.3
2002/0009635 A1 1/2002 Michot et al.
2002/0013381 A1 1/2002 Armand et al.
2002/0114996 A1 8/2002 Schmidt et al.
2003/0185749 A1 10/2003 Mahajan
2004/0022716 A1 2/2004 Mahajan
2005/0136332 A1 6/2005 Sueto et al.
2007/0227896 A1 10/2007 McNulty et al.
2008/0013177 A1 1/2008 Hatano et al.
2008/0219918 A1 9/2008 Lee et al.
2010/0046142 A1 2/2010 Aitchison et al.
2018/0057369 A1 3/2018 Lu et al.

FOREIGN PATENT DOCUMENTS

CN 113074360 A * 7/2021 ..... F23D 14/78
WO WO-2014068610 A1 * 5/2014 ..... F22B 1/284
WO WO-2016204767 A1 * 12/2016 ..... F22B 9/14

* cited by examiner

FIRE WATER PLANT I

RELATED APPLICATION(S)

This application is a continuation-in-part of U.S. patent application Ser. No. 17/820,222, filed 22 Aug. 2022, pending, which is incorporated into this document by this reference.

BACKGROUND ART

Most hydrogen produced today in the United States is made via steam-methane reforming, a mature production process in which high-temperature steam (700° C.-1,000° C.) is used to produce hydrogen from a methane source, such as natural gas. Unfortunately, this hydrogen production process is not a green or carbon-neutral process.

Hydrogen has been used as fuel in hydrogen-oxygen welding processes and has been mixed into hydrocarbon fuels. But if hydrogen is combusted with nitrogen present, NOx is produced. For example, see FIG. 1 in which a mixture of hydrogen (H2), hydrocarbon fuel, and air are supplied to a boiler to produce steam to power a steam-powered process or device. But the boiler also produces NOx in the combustion gases.

NOx stands for mixtures comprising nitric oxide (NO) gases and nitrogen dioxide (NO2) gases, which are substantial causes of air pollution. These gases contribute to the formation of smog and acid rain. NOx gases are usually produced from the reaction between nitrogen and oxygen during the combustion of fuels, such as hydrocarbons, in air. These gases can be further oxidized in the atmosphere to nitric acid. In large cities, nitrogen oxides are a significant source of air pollution.

An inexpensive hydrogen source gives rise to the need for a hydrogen boiler.

SUMMARY

We disclose a device containing among other components a combustion chamber, a pressure vessel, and a burner. In some versions, the combustion chamber includes a combustion chamber vessel, a combustion chamber outlet, a combustion chamber inlet and a fire tube. In these or other versions, the pressure vessel contains condensing coils associated with the combustion chamber outlet, a firewater outlet associated with the condensing coils, a water jacket surrounding condensing coils, a head space above water in the water jacket, a high-pressure steam outlet associated with the head space, and a high-pressure steam inlet associated with the head space. In these or other examples, the burner is associated with the combustion chamber inlet and sometimes has a burner fuel nozzle and a de-superheat nozzle. In these or other versions, the de-superheat nozzle is positioned to spray water in front of the burner nozzle. Depending upon the version of the device, the steam inlet sits above the water level in the pressure vessel. Various versions of these devices are disclosed in which the burner has a pilot fuel nozzle, a spark ignition system, and a flame detector. An ultraviolet flame detector can be used as the flame detector, although other types of flame detectors are useful in these devices.

Various burners disclosed as components of these devices connect to a hydrox fuel train through a burner fuel nozzle that has an inlet to receive hydrox fuel. Various burner management systems can be included in the disclosed devices including burner management systems that are associated with the fuel train, the burner fuel nozzle, the pilot fuel nozzle, the spark ignition system, and the flame detector. Additionally, some burners useful with the disclosed devices have one or more additional burner fuel nozzles and one or more additional de-superheat nozzles position to spray downstream of the burner fuel nozzles. Likewise, some burners with additional burner fuel nozzles use a single de-superheat nozzle, as desired.

The fuel train has a vapor separator, and the inlet to the fuel train is connected to the vapor separator in some versions. The fuel train may further include an anti-back-fire tank.

In some versions of the disclosed devices, steam from combustion in the fire tube never mixes with process steam produced by the devices.

DETAILED DESCRIPTION

Figure 1:
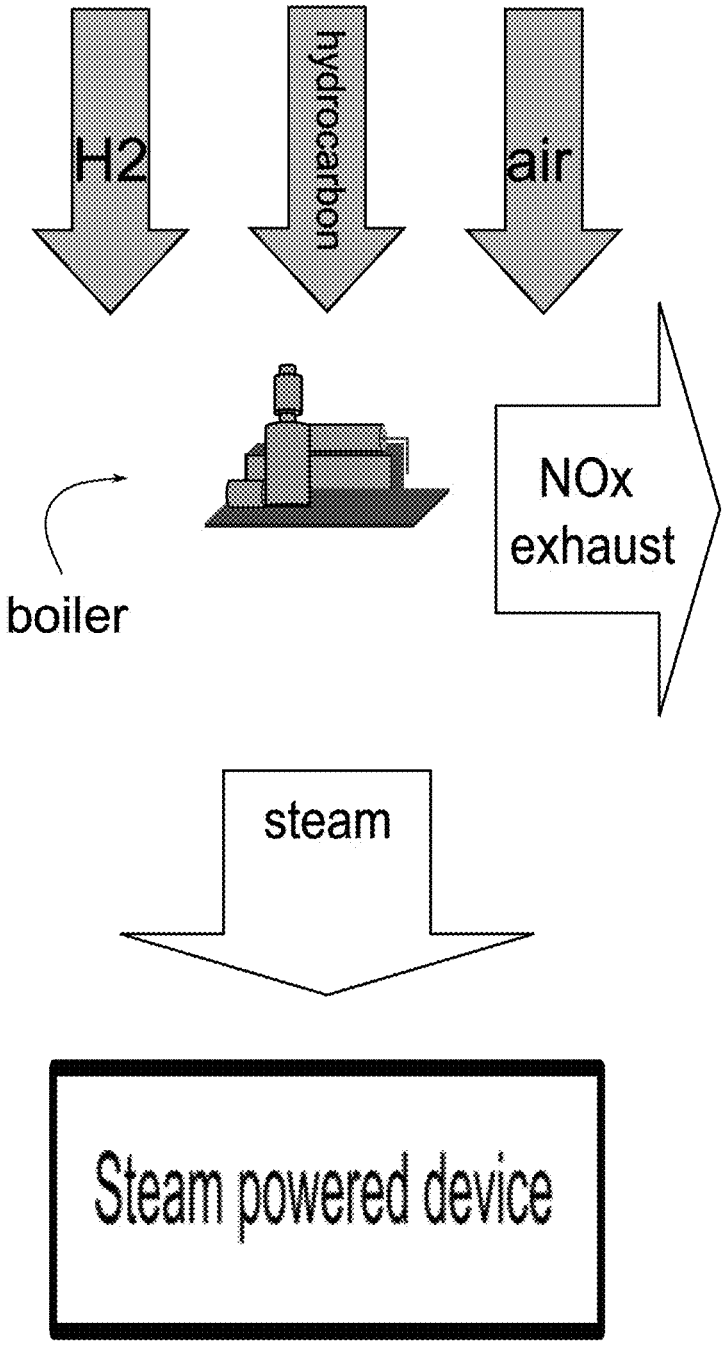
FIG. 1 (prior art)
FIG. 1 depicts a diagram showing a prior art process.

To the extent that the material doesn't conflict with the current disclosure, this disclosure incorporates by reference the entire contents of the following patent application Ser. Nos. 17/153,845; 63/120,931; 63/079,778; 63/021,825; 63/052,369; 63/052,367; 62/963,300; 17/152,663; 63/021,928; 62/903,369; 16/682,503; 16/682,517; 17/079,949; 63/172,599; 17/316,647; 17/316,535; 17/336,393; 17/336,404; 17/336,407; 17/336,417; 17/336,431; 17/336,442; 17/336,699; 17/337,234; and 17/337,240.

Unless defined otherwise, all technical and scientific terms used in this document have the same meanings as commonly understood by one skilled in the art to which the disclosed invention pertains. Singular forms—a, an, and the—include plural referents unless the context indicates otherwise. Thus, reference to "fluid" refers to one or more fluids, such as two or more fluids, three or more fluids, etc. When an aspect is to include a list of components, the list is representative. If the component choice is limited explicitly to the list, the disclosure will say so. Listing components acknowledges that implementations exist for each component and any combination of the components—including combinations that specifically exclude any one or any combination of the listed components. For example, "component A is chosen from A, B, or C" discloses implementations with A, B, C, AB, AC, BC, and ABC. It also discloses (AB but not C), (AC but not B), and (BC but not A) as implementations, for example. Combinations that one of ordinary skill in the art knows to be incompatible with each other or with the components' function in the invention are excluded, in some implementations.

When an element or layer is called being "on", "engaged to", "connected to" or "coupled to" another element or layer, it may be directly on, engaged, connected, or coupled to the other element or layer, or intervening elements or layers may be present. When an element is called being "directly on", "directly engaged to", "directly connected to", or "directly coupled to" another element or layer, there may be no intervening elements or layers present. Other words used to describe the relationship between elements should be interpreted in a like fashion (e.g., "between" versus "directly between", "adjacent" versus "directly adjacent", etc.).

Although the terms first, second, third, etc., may describe various elements, components, regions, layers, or sections, these elements, components, regions, layers, or sections should not be limited by these terms. These terms may distinguish only one element, component, region, layer, or section from another region, layer, or section. In addition, terms such as "first", "second", and other numerical terms do not imply a sequence or order unless indicated by the context. Thus, a first element, component, region, layer, or section discussed below could be termed a second element, component, region, layer, or section without departing from this disclosure.

Spatially relative terms, such as "inner", "outer", "beneath", "below", "lower", "above", and "upper," may be used for ease of description to describe one element or feature's relationship to another element or feature as illustrated in the figures. Spatially relative terms may be intended to encompass different orientations of the device in use or operation besides the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations), and the spatially relative descriptors interpreted.

The description of the implementations has been provided for illustration and description. It is not intended to be exhaustive or to limit the invention. Individual elements or features of a particular implementation are not limited to that implementation but, where applicable, are interchangeable and can be used in a selected implementation, even if not explicitly shown or described. The same may also be varied. Such variations are not a departure from the invention, and all such modifications are included within the invention's scope.

COMPONENTS

Figure 2:
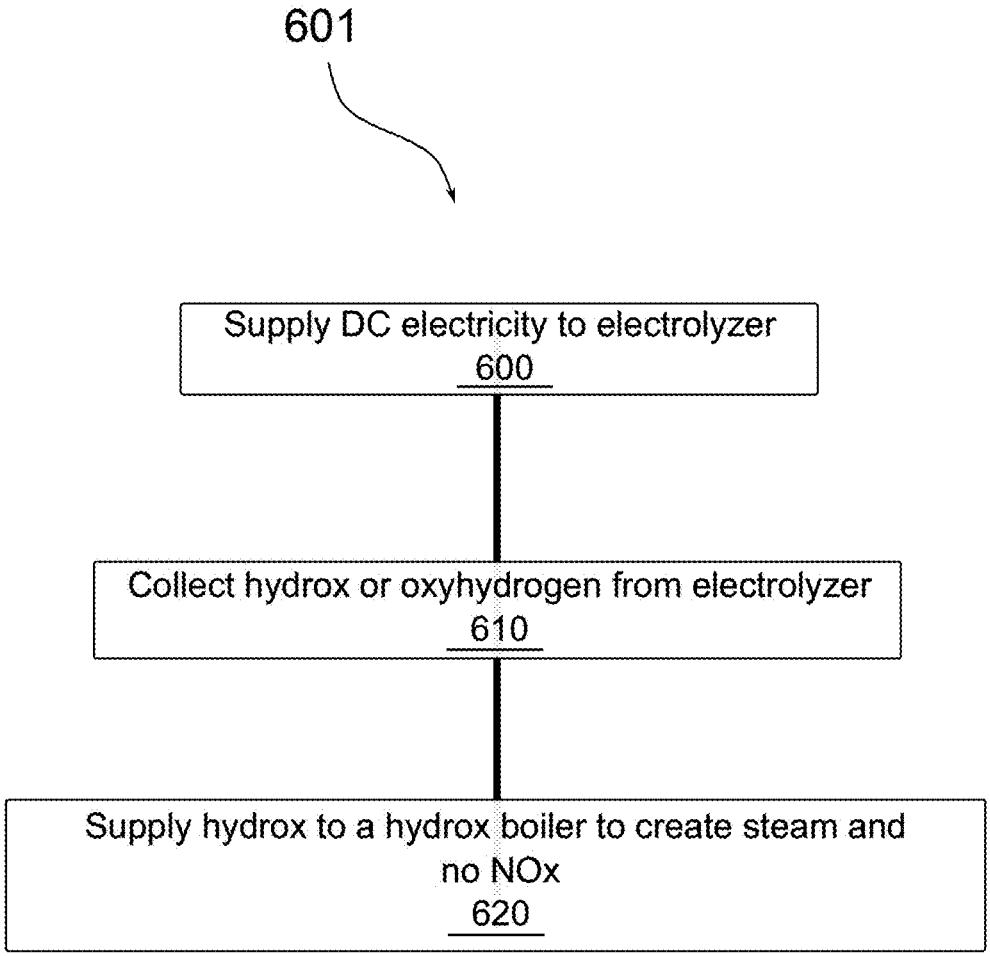
FIG. 2 depicts a flowchart.

10 hydrox electrolyzer
20 facility process-stream system
100 boiler feed water source
101 boiler high pressure steam inlet
102 compressed air source
106 cooling water source
108 cooling water return
110 firewater out
112 hydrox fuel inlet
114 purified water
116 anti-backfire tank
118 vapor separator
120 firewater tank
121 anti-backfire tank
122 fuel vapor separator
124 economizer
126 pressure vessel
128 fire tube
130 burner management system
131 burner
132 pilot fuel nozzle
134 burner fuel nozzle
136 de-superheat nozzle
138 high-pressure steam inlet
140 coil
142 high-pressure steam outlet
144 combustion chamber
146 heat exchange region
148 boiler
150 boiler tank
152 flame-arresting safety system
154 fuel line
156 pilot line
158 sparking ignition system
160 fuel train
162 ultraviolet flame detector
164 firewater outlet
166 high pressure steam source
168 hydrox boiler system FIG. 2 depicts a flowchart illustrating process 601. Step 600 includes supplying DC electricity to an electrolyzer. Step 610 encompasses producing a mixture of hydrox (oxyhydrogen, HHO) by any known method. This hydrox is supplied to a hydrox boiler 148 in step 620 for generating industrial steam.

Figure 3:
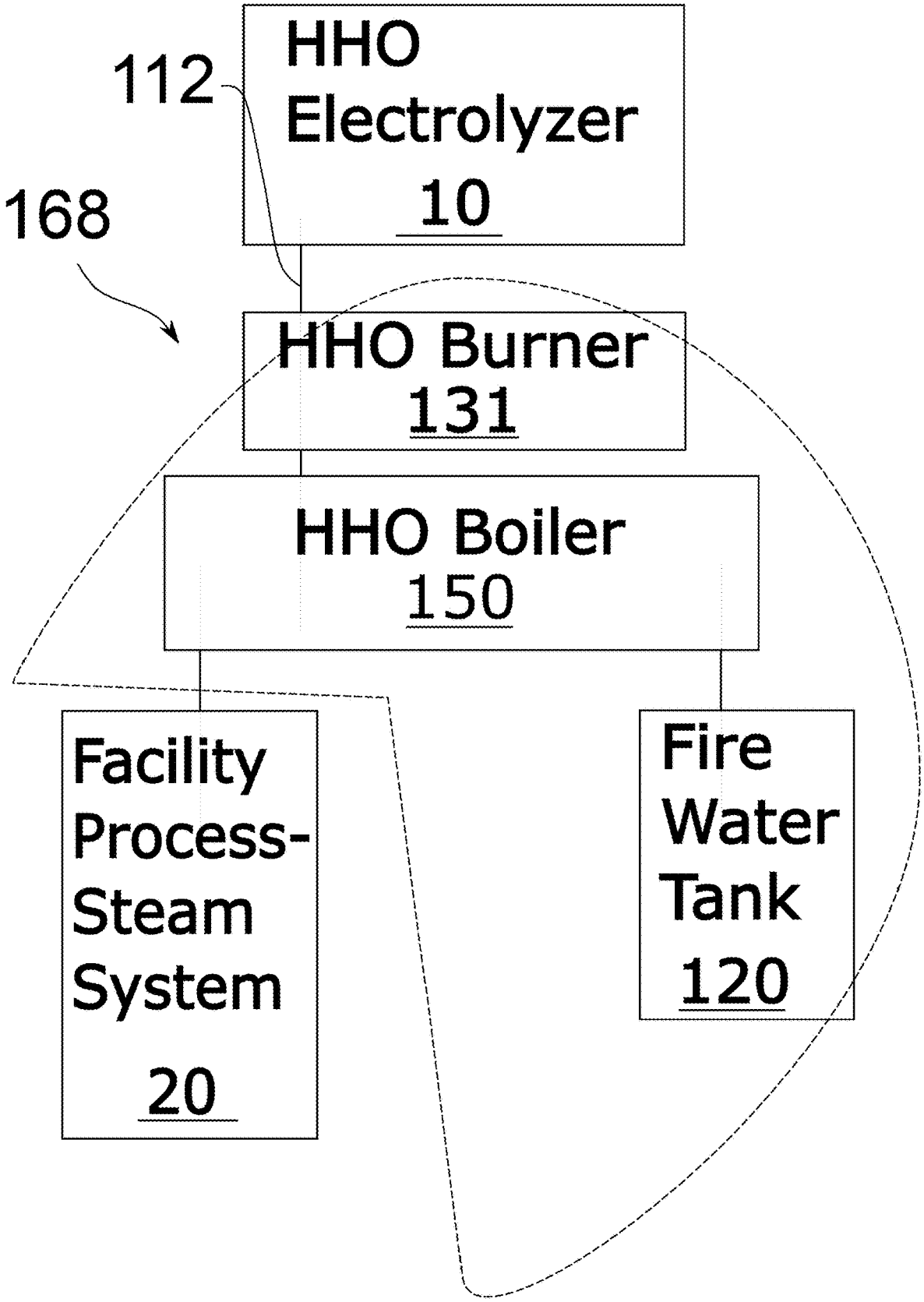
FIG. 3 depicts a schematic showing an HHO production process.

FIG. 3 shows a schematic of a hydrox boiler system 168. HHO electrolyzer 10 feeds hydrox to hydrox boiler system 168 through hydrox fuel Inlet 112. Boiler system 166 has HHO burner 131 or burner 131 connected to HHO boiler 150 or boiler 150. Boiler 150 connects to a firewater tank 120 and separately connects to facility process steam system 20. In this version of hydrox boiler system 168, HHO electrolyzer 10 and facility process steam system 20 are not part of hydrox boiler system 168. In some versions, boiler 150 has two connections to facility process steam system 20.

Figure 4:
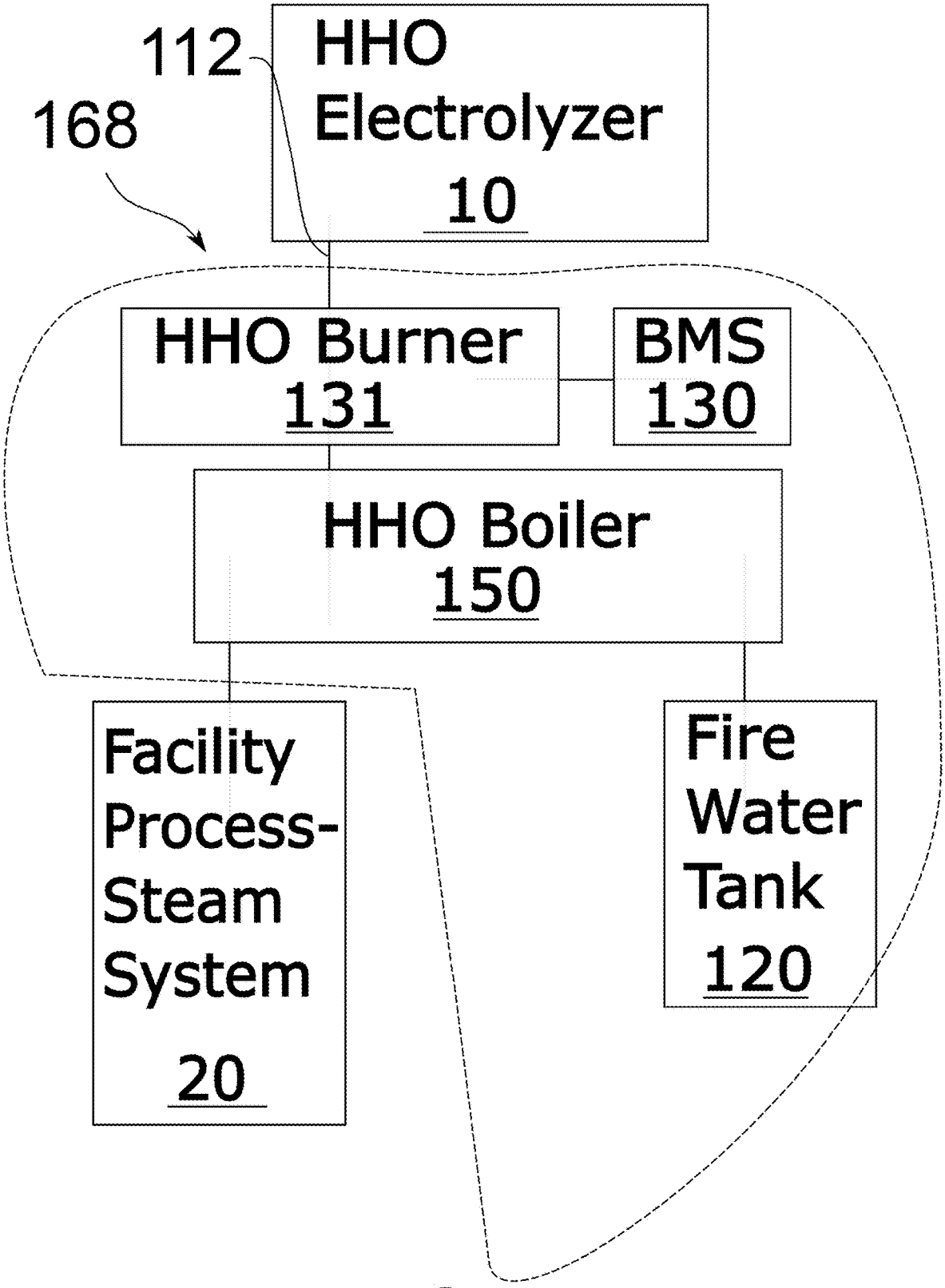
FIG. 4 depicts a schematic showing another HHO production process.

Similarly to FIG. 3, FIG. 4 shows a schematic of a hydrox boiler system 168. HHO equalizer 10 feeds hydrox to hydrox boiler system 168 through hydrox fuel Inlet 112. Boiler system 166 has HHO burner 131 or burner 131 connected to HHO boiler 150 or boiler 150. Boiler management system (BMS) 130 is depicted connecting to HHO burner 131. Boiler 150 connects to a firewater tank 120 and separately connects to facility process steam system 20. In this version of hydrox boiler system 168, HHO electrolyzer 10 and facility process steam system 20 are not part of hydrox boiler system 168. In some versions, boiler 150 has two connections to facility process steam system 20.

Figure 5:
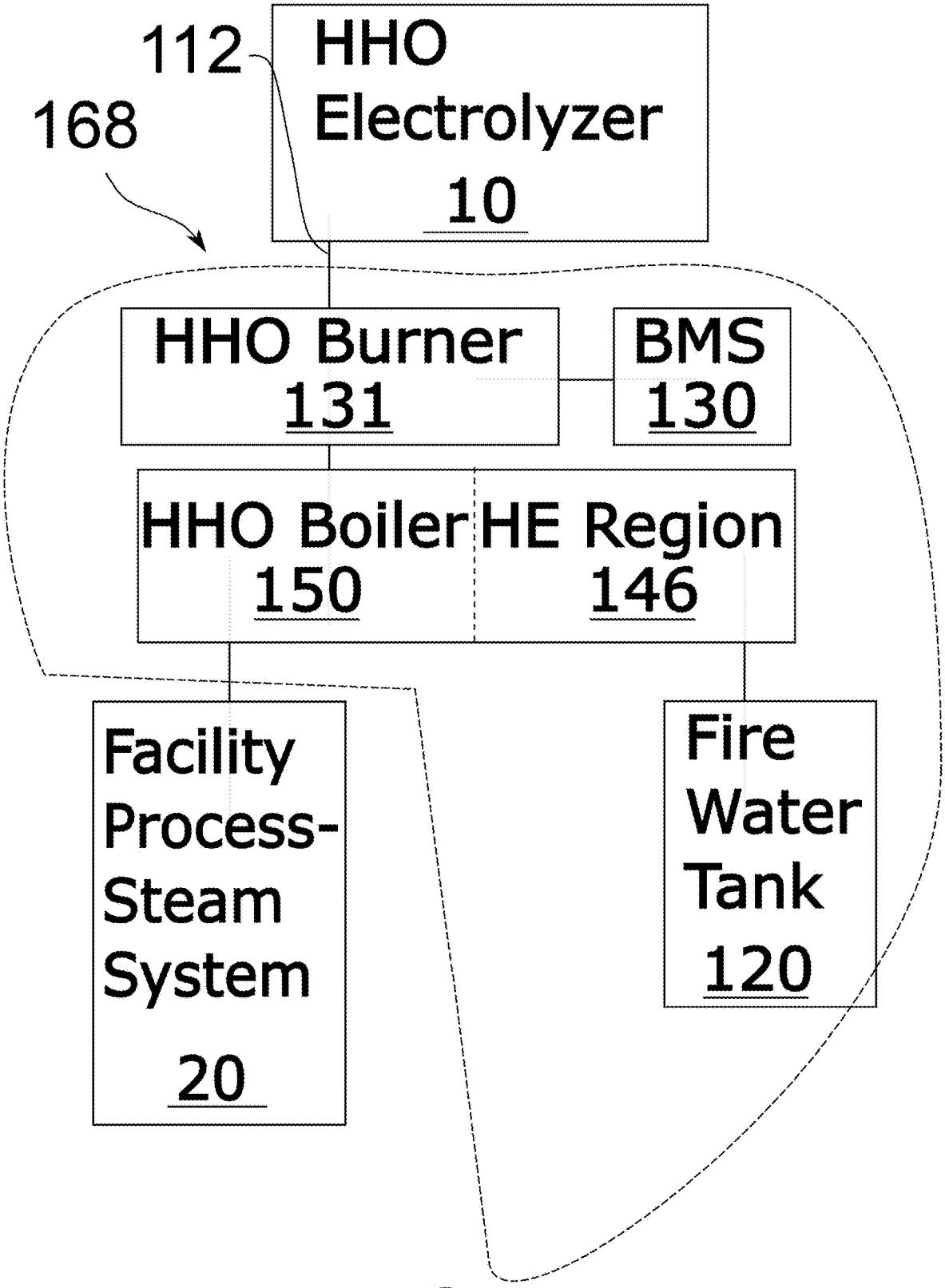
FIG. 5 depicts a schematic showing another HHO production process.

Similarly to FIG. 3, FIG. 5 shows a schematic of a hydrox boiler system 168. HHO electrolyzer 10 feeds hydrox to hydrox boiler system 168 through hydrox fuel Inlet 112. Boiler system 166 has HHO burner 131 or burner 131 connected to HHO boiler 150 or boiler 150. Boiler management system (BMS) 130 is depicted connecting to HHO burner 131. Boiler 150 has heat exchanger region 146, connects to a firewater tank 120, and separately connects to facility process steam system 20. In this version of hydrox boiler system 168, HHO electrolyzer 10 and facility process steam system 20 are not part of hydrox boiler system 168. In some versions, boiler 150 has two connections to facility process steam system 20. In addition, in some versions, HE region 146 contains a heat exchanger, such as coil 140 (see FIG. 6), connected between burner 131 and firewater tank 120.

Figure 6:
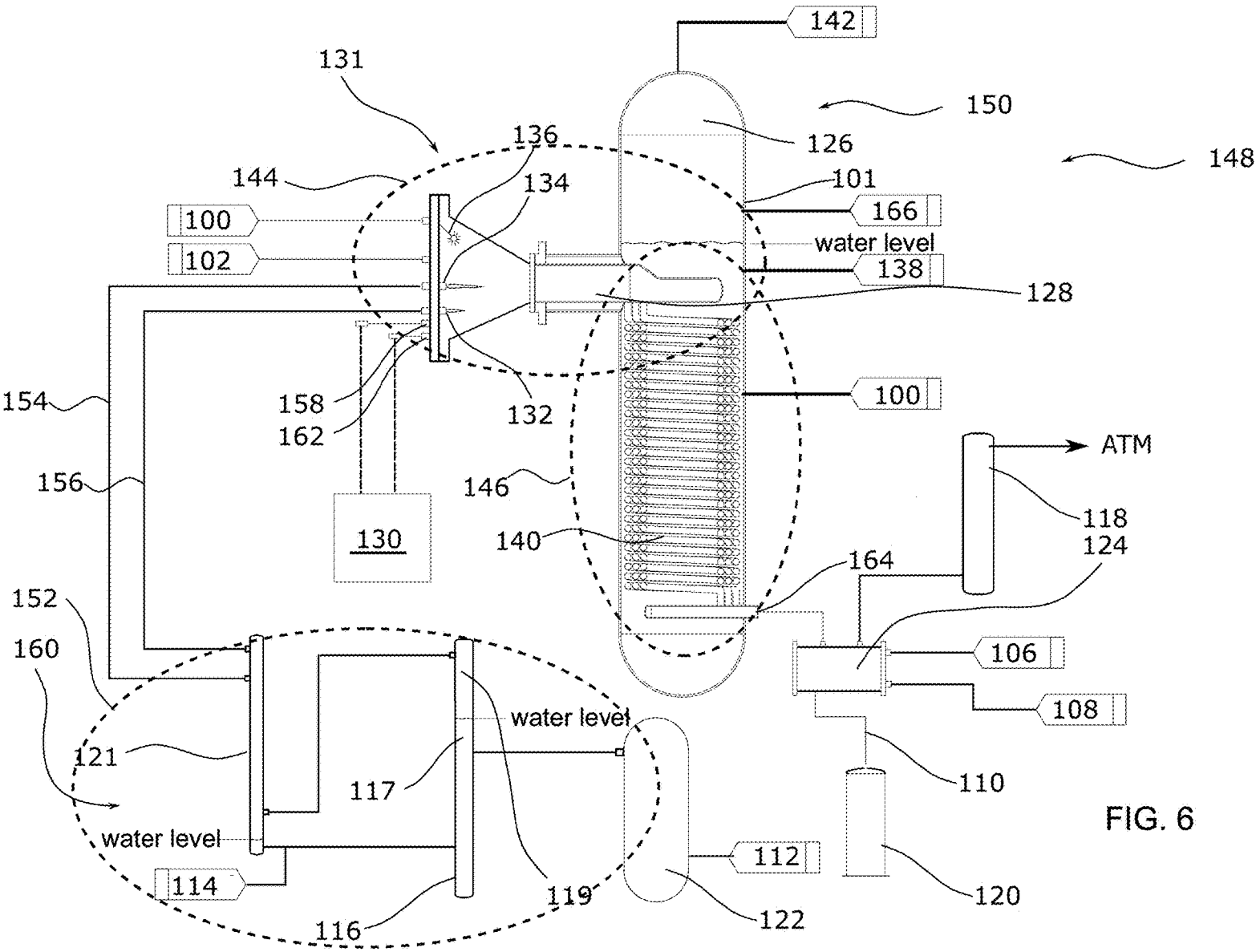
FIG. 6 depicts a schematic showing another HHO production process.

FIG. 6 depicts a schematic example of a version of a hydrox boiler system 168. System 168 feeds hydrox into fuel vapor separator 122 through hydrox fuel Inlet 112. Fuel vapor separator 122 separates water or other vapor potentially present in the hydrox fuel stream from the hydrox fuel itself before allowing hydrox fuel to flow to other components of hydrox boiler system 168. This separation is sometimes necessary because some versions of hydrox boiler system 168 receive hydrox fuel from a water-based electrolyzer, which causes a potential for water to be entrained or carried along with hydrox fuel from such electrolyzer.

Fuel train 160 connects to vapor separator 122. Fuel train 160 contains one or more anti-backfire tanks 116, which contain a water column connected to a dry anti-backfire tank 121. Purified water feed 114 feeds anti-backfire tank 116 (or multiple instances of this tank) and anti-backfire tank 121. Fuel line 154 and pilot line 156 connect to anti-backfire tank 121 and lead to burner 131. Specifically, fuel line 154 leads to burner fuel nozzle 134 in burner 131, and pilot line 156 leads to pilot fuel nozzle 132 in burner 131.

Additionally, burner management system (BMS) 130 connects to burner 131. BMS 130 contains solid-state or analog logic circuitry to control operational aspects of burner 131. BMS 130 connects to sparking ignition system 158 and ultraviolet flame detector 162. These components are mounted in burner 131, as well. In some versions, sparking ignition system 158 provides sparks to pilot line 156 at pilot fuel nozzle 132, and ultraviolet flame detector 162 monitors a flame on pilot line 156 at pilot fuel nozzle 132.

Burner 131 also connects to a compressed air source 102 and an inlet for purified water, which enters burner 131 through de-superheat nozzle 136. In this version, burner 131 outputs to fire tube 128. Fire tube 128 sits partially within boiler tank 150 in this version. Fire tube 128 is completely outside boiler tank 150 and completely inside boiler tank 150 in various other versions. Boiler tank 150 has a pressure vessel 126 and contains coil 140 submerged in water located in boiler tank 150 and a high-pressure steam outlet 142. In some versions, the level of water completely submerges coil 140. Boiler tank 150 has firewater outlet 164, which connects to the downstream end of coil 140. Fire tube 128 connects to the upstream end of coil 140. As discussed below, during operation, combustion gases from burner 131 travel through fire tube 128 to coil 140 and ultimately out of boiler tank 150 through firewater outlet 164.

Fire outlet 164 connects to economizer 124. Economizer 124 connects to vapor separator 118, which can vent to atmosphere (in some versions, this is a safety feature). Economizer 124 connects to and drains firewater through firewater outlet 110 into firewater tank 120. Economizer 124 connects to cooling water source 106 and cooling water return 108.

Boiler tank 150 receives water through boiler feed water source 100.

Hydrox Boiler Operation

As shown in FIG. 6, the hydrox boiler 148 generates steam by combusting HHO gas in a fire tube 128 and condensing the reactant in a helical coil 140 to extract the latent heat of combustion for steam generation. This process has neither carbon dioxide emissions nor NOx emissions.

There are no carbon-based fuels used in the hydrox process, and therefore, no CO2 emissions.

The atmosphere has many components including nitrogen at 73% by volume. When nitrogen reaches 1200 F, the undesirable greenhouse gas called NOx unavoidably forms. The simplicity of the hydrox boiler 148 is that it avoids NOx formation without requiring equipment to evacuate atmospheric conditions to eliminate nitrogen from within the combustion area. This simplicity reduces operational complexities and construction costs. As the hydrox combustion process occurs, the exothermic reaction will generate steam in the fire tube 128, and as the steam expands, will scrub out all atmospheric conditions from the fire tube 128 through the economizer 124. After minutes of operations, there will be no nitrogen in the combustion region 144 and heat exchange region 146 of the hydrox boiler 148 to produce NOx, and therefore, no NOx emissions.

At point of combustion, superheated steam is generated with a flame temperature of 3025 F. This superheated steam will cool to 100% saturated steam conditions and condense in the boiler tubes as condensate, utilizing the reaction heat for steam production.

The hydrox boiler 148 will be controlled by two independent control systems. A primary control system will manage all boiler operations and sequences and use proven industry standard controllers, pneumatically controlled fail open-closed spring-operated control valves, mechanical safety relief valves, and all readily available typical components. A second control system will be the Burner Management System (BMS) 130. This independent system will use electrically controlled level switches, pressure switches temperature switches, flow valves and flow detection for safety purposes. BMS 130 is the master controller if boiler operations depart from desired ranges. BMS 130 can safely de-energize all energy sources in the boiler 148.

Start Up

The hydrox boiler 148 will be pre warmed prior to igniting the HHO fuel stream in the fire tube 128. This pre warm function will reduce the boiler 148 start-up period because it will pre-heat the boiler pressure vessel 126 and boiler water. In some versions pre-heating is to 400 F at 250 psig pressure. The liquid level in the boiler should be at 80% or larger. In some versions, this level is indicated by a remote level sensor (not shown).

An external steam supply line (sometimes a 350 psig high pressure steam header) serves as the heating source. A valve (not shown) allows steam to flow through a pressure regulating valve to maintain 250 psig pressure in the boiler tank 150. This steam pressure can be seen locally with an optional pressure or temperature sensor. In some versions, the steam will maintain the vessel and boiler feed water at 400 F. As high-pressure steam condenses in the boiler 148, and the water level rises, a valve will allow boiler water to safely drain and flash into the vapor separator tank 118. In some versions, vapor separator tanks vent to atmosphere.

Fuel Train

The fuel train 160 starts at the HHO gas vapor separator 122 and terminates in the fire tube 128. Before fuel train 160 is pressurized and boiler 148 fired, the control systems complete the following procedure to ensure the flame-arresting safety system 152 is functional.

Fuel train 160 has one or more anti-backfire tanks in series. FIG. 6 shows a single anti-backfire tank. The anti-backfire tanks prevent combustion gasses from flowing from the fire tube 128 back to the fuel train 160. In some versions, anti-backfire tanks 116 have an 18" diameter shell and a 72" height with fitting and controls to manage water level, gas flows, and safety relief valves. Each tank 116 requires the pressurized HHO gas to travel upward through a water column into the head space 119. There are mechanical safety relief valves not shown connected to vapor separator 122. The safety discharge lines (not shown) are piped to control any releases to a safe environment.

There is a second style of anti-backfire tank, tank 121, positioned downstream from the anti-backfire tank 116. Tank 121 is different from the others; it is dry. Tank 121 has fittings to deliver HHO gas to burners 131, intermittent drains (not shown), and safety relief valves (not shown). In some versions, tank 121 has a 12" diameter shell and is 72" tall. There are mechanical safety relief valves (not shown)

on each anti-backfire tank. The safety discharge lines (not shown) are piped to control any releases to a safe environment.

The appropriate water level in tank 116 is automatically maintained by supplying purified water through a valve. In some versions, boiler tank 150 has a sight glass on boiler tank 150 to verify proper water column height. Tank 116 is provided with a low-level switch that is tied to BMS 130. If this switch level requirement is not met, or lost, BMS 130 will automatically shut down the hydrox boiler operations and start the HHO gas system purge cycle.

When a second anti-backfire tank is used, appropriate water level in it is automatically maintained by supplying purified water through a valve. In some versions, there is a local pressure gage mounted on the tanks. In these or other versions, there is a sight glass on tank 116 to verify proper water column height. Tank 116 has a low-level switch connected to BMS 130. If this switch level requirement is not met, or lost, BMS 130 will automatically shut down the hydrox boiler 148 operations and start the HHO gas system purge cycle. The HHO gas exiting anti-backfire tank 116 travels to anti-backfire tank 121. Tank 121 directly feeds burner nozzle 134 through fuel line 154.

Pressure indicators transmitters (not shown) sit upstream of burner 131. This pressure-flow management scheme will ensure proper fuel characteristics, such as energy density and nozzle velocity requirements.

Some versions have multiple burner nozzles. The purpose of multiple burner nozzles is to provide boiler turn down and steam production throttling capabilities. Inversions in which the ultimate source of HHO is solar electric, the solar energy varies though the day and seasons, the HHO gas production will also vary, and multiple nozzles will allow the burner fuel demand to match the varying gas production. Sometimes HHO production will be lower, sometimes higher.

For the hydrox boiler 148 burners to function, minimum HHO gas velocities need to be maintained at the nozzle 134. As HHO gas varies in pressure and temperature, the specific volume of HHO gas varies considerably. The change in specific volumes affects the nozzle tip discharge velocities.

The hydrox boiler 148 control system has two ways to manage the changing fuel supply. The first is to fix the burner supply pressure in fuel line 154 to the desired range of 50 to 60 psig. This is accomplished by monitoring the burner fuel line pressures and only allowing HHO to the nozzles 134 at a desired pressure.

The second way is to meter the HHO gas flow and, with known flows, turn burners on and off as required to provide desired nozzle exit velocity. In the morning, less gas is made. So, a burner uses fewer nozzles. As the day progresses, additional (sometimes larger) nozzles or burners are added to the overall combustion process to maintain proper nozzle exit velocities. As the day ends, burners or nozzles are removed from service to maintain proper velocities.

Any air contained in the process tanks and piping systems will be displaced by incoming water and by HHO gas delivery as it vents through the following HHO gas flow valves. The air within the process will be forced through the burner 131 (including fire tube 128), coils 140, economizer 124, and discharge through the vapor separator 118 to the atmosphere.

Combustion

After the anti-backfire tanks 116, 121 have been initializing, and BMS 130 requirements have been verified on all liquid levels, pressure levels, and temperature levels, the system purges at least burner 131, fire tube 128, and combustion region 144 with compressed air to eliminate combustible levels of accumulated HHO gas. This step provides controlled combustion practices.

A pressure relief valve (not shown) drops the pressure in the line from the compressed air source 102 from 100 psig to 30 psig. A check valve (not shown) and a flame arrestor (not shown) sit in the line that pressurizes the combustion chamber 144 through the vapor separator 118. This purge process continues until a detector indicates that all HHO gas has been dissipated. Alternatively, the purge process duration can also be controlled by a timer.

Ignition

Ignition begins with engaging the sparking ignition system. This system sends a continuous stream of sparks near the pilot fuel nozzle 132. This system has an electrical generator discharging sparks into the combustion chamber 144 directly in front of the pilot nozzle 132.

This ignition source is energized before delivering HHO gas to the pilot nozzle 132. HHO gas flows to the pilot nozzle 132 through a flame arrestor and fuel meter. The spark stream continues until the pilot flame is detected by an ultraviolet flame detector 162. If the ultraviolet flame detector 162 ever loses confirmation of burn, flow of HHO fuel ceases. Before restarting the system, the air purge process is applied.

After stable pilot flame operation (10-30 seconds in some versions), fuel flow to burner fuel nozzle 134 starts, which the pilot flame ignites. In some versions, fuel flow only starts if the desired header pressure is detected. In these or other versions, BMS 130 monitors the pilot flame and after the flame is stable and the pressure in fuel headers is between 50 to 60 PSIG, opens one or more valves to provide fuel to burner fuel nozzle 134. In some versions, BMS 130 controls the number of burners in use at a given time. As more HHO fuel is provided to the supply header and line pressures increase, additional burners come online. Likewise, as the HHO fuel supply decreases, burners will be removed.

Boiler Fire Tube

At this point, the chemical reaction of burning HHO gas will create a discharge of superheated steam proportional to the amount of HHO gas delivered to the fire tube 128. This reaction generates 58,000 btu per pound of hydrogen stoichiometrically combusted with oxygen. The combustion process will produce a fire (ultraviolet flame) and steam that condenses back to water. This combustion product is called "firewater" to distinguish it from the process steam that the generated heat is used to produce.

The flame will initially combust at 3025 F as superheated steam and cool to 100% saturated steam conditions. A heat absorption water spray (HA) directly onto the HHO flame pattern will expedite this phase change process in the fire tube 128. Saturated steam provides an environment with higher heat transfer coefficients and reduced condensing surface area requirements.

The desuperheat function improves the overall heat transfer coefficient in the coils. But it also provides a way to manage the high combustion temperatures realized when burning hydrogen in HHO gas streams or direct separate hydrogen and oxygen streams.

The HA flow control valve supplies boiler feed water 100 into a HA nozzle directed to the main flame or flames to produce a saturated steam HHO flame to condense inside coil 140, which are heat exchange pipes knowns as boiler tubes. The hydrogen steam condenses on the inside of the boiler tubes, and with gravity collects as a liquid in the economizer 124.

The combustion chamber slopes away from the combustion nozzle end to avoid condensate pooling in the combustion zone.

In some versions, standard techniques remove even more energy from the firewater before it drains from the system. In some versions, the firewater is cooled (such as 200° F.). The firewater can be returned to a hydrox generator for re use. Some versions used cooled water for the de-superheat processes.

The final release of firewater from the boiler coil 140 will enter the economizer 124. This firewater will be cooled with a flow of water originating at the existing cooling water source 106 and returning through cooling water return 108.

Fuel Safety

The hydrox boiler fire tube 128 can detect the internal pressure in the combustion chamber 144. If this pressure exceeds (such as 75 psig), BMS 130 will shut all fuel supply lines to the fire tube 128.

Economizer

In some versions, economizer 124 is an ASME pressure vessel waited to withstand tube or other steam-handling failures. In some versions, the pressure rating is 400 psig on the shell side, the tube side, or both. The mechanical strength of the economizer 124 will withstand any operating pressures potentially realized with tube failures. There will be two flows discharging the economizer 124, one from the shell side and one from the tube side Boiler The hydrox boiler 148 is designed to an allowable maximum working pressure and temperature appropriate for the scale of the boiler. In some versions, this maximum allowable internal pressure of 400 psig and maximum working temperature of 450 F. Pressure vessel 126 internally holds the boiler tubes, boiler water at 450 F and 400 psig steam.

When the HHO gas exothermic reaction in the boiler fire tube 128 has delivered the required amount of BTUs to raise the boiler feed water temperature to the desired operating boiler steam temperature and provide the required amount of latent heat of evaporation per pound of water to achieve 365 psig saturated steam the boiler steam will discharge through a high-pressure steam outlet.

The steam produced in the boiler 148 connects to the existing 350 psig high pressure steam header, which provides process steam to a facility.

In some versions, BMS 130 monitors one or more of the following control points. Ultraviolet flame detector 162. If the flame is not detected, BMS 130 de-energizes all boiler functions.

Low level of boiler water. If the low level is reached, BMS 130 de-energizes all boiler functions. High temperature in combustion chamber 144. If the temperature exceeds 1600 F, BMS 130 will de-energize all boiler functions. High mission pressure alarm. If the pressure reaches 75 psig, BMS 130 de-energizes boiler.

DEFINITIONS (FOR PURPOSES OF THIS DISCLOSURE)

Generally, an industrial process is any process that uses heat at a rate equivalent to greater than 2000, 5000, 10,000, 15,000, 20,000, 40,000, 80,000, 160,000, or 320,000 pounds of steam per hour, depending on the embodiment. Industrial heat refers to many methods by which heat is used to transform materials into valuable products. For example, heat is used to remove moisture, separate chemicals, create steam, treat metals, melt plastics, Agricultural space and media heating, cooking, pressurization, sterilization, and bleaching, industrial distillation, concentrating, drying, or kilning, and chemical or other high-temperature processes, silicon and other refining, including semiconductor production, and much more. Depending upon the process involved, industrial heat can be broken down into low-, medium-, and high-temperature heat. For instance, cement kilns require high temperatures, while drying or washing applications in the food industry operate at lower temperatures. Various practical processes and devices include but are not limited to drying, primary steam reforming, steam, steeping, drying, combustion gases, heating kilns, calciners, crystallizers, dryers, stock preparation, wood digesting, bleaching, evaporation, chemical preparation, primary reforming, methanol distillation, byproduct drying (corn dry mills pretreatment and conditioning, lignocellulosic processes), and furnaces such as cracking furnaces.

Process steam is the steam system in a facility that transfers process heat throughout the facility. Firewater is the water produced in the combustion process that in some versions does not mix with the process steam in the boiler.

For purposes of this disclosure, a hydrogen boiler is any boiler that has been specifically modified to use hydrogen as combustion fuel. For purposes of this disclosure, a hydrox boiler is any boiler that has been specifically modified to use a mixture of hydrogen and oxygen (such as hydrox) as the reactants in a boiler. In some embodiments, this definition includes a modified condensing boiler. In these or other embodiments, the mixture of hydrogen and oxygen is generated locally to the boiler by electrolysis and not separated before delivery to the boiler. In other embodiments, the mixture is prepared before entry into the boiler. In these or other embodiments, the mixture is prepared simultaneously with entry into the boiler or prepared shortly after entry into the boiler.

In some implementations, "Flat on ground (FOG)" refers to a group of greater than 50, 100, 200, 400, 600, 800, 1000, or 1500 modules in which at least 80 percent of the modules have at least one contact point, as defined below, that rests on the ground or rests on a contact surface of one or more structures, provided that the portion or portions of the structure or structures encompassed by the volume of space beneath and perpendicular to the contact surface is solid or constrains air movement. In some implementations, "Flat on ground (FOG)" means any flat mounting substantially parallel to the earth or ground that places the plane of the array within a short distance above the ground. This disclosure sometimes uses "ground-mounted" as a synonym for "Flat on ground (FOG)". In some versions, "flat" means horizontally flat and substantially parallel to the earth. In some implementations, a "ground module" is an Flat on ground (FOG) module.

In some implementations, "ground level" is the level of the ground immediately before module installation.

Having thus described some embodiments of the invention, other variations and embodiments that do not depart from the spirit of the invention will become apparent to those skilled in the art. The scope of the present invention is thus not limited to any particular embodiment but is instead in the appended claims and the legal equivalents thereof. Unless stated in the written description or claims, the steps of any method recited in the claims may be performed in any order capable of yielding the desired result. No language in the specification should be construed as indicating that any non-claimed limitation is included in a claim. The terms "a" and "an" used in the context of describing the invention

(especially in these claims) are to be construed to cover both the singular and the plural unless otherwise indicated or contradicted by context.

The invention claimed is:

1. A device comprising:

a combustion chamber having a fire tube;

a pressure vessel containing;

condensing coils;

a firewater outlet associated with the condensing coils;

water surrounding the condensing coils;

a headspace above the water;

a high-pressure steam outlet associated with the headspace; and a high-pressure steam inlet associated with the headspace; and a burner having a burner fuel nozzle and a de-superheat nozzle.

2. The device of claim 1, wherein the de-superheat nozzle is positioned to spray water in front of the burner fuel nozzle.

3. The device of claim 2, wherein the high-pressure steam inlet sits above the water in the pressure vessel.

4. The device of claim 3, wherein the burner further comprises a pilot fuel nozzle, a spark ignition system, and a flame detector.

5. The device of claim 4, wherein the flame detector is an ultraviolet flame detector.

6. The device of claim 4 further comprising a hydrox fuel train that is associated with a burner fuel nozzle and has a fuel train inlet to receive hydrox fuel.

7. The device of claim 6 further comprising a burner management system associated with the fuel train, the burner fuel nozzle, the pilot fuel nozzle, the spark ignition system, and the flame detector.

8. The device of claim 7, wherein the burner has one or more additional burner fuel nozzles and the de-superheat nozzle is positioned to spray water downstream of the burner fuel nozzles.

9. The device of claim 8, wherein the fuel train further comprises a vapor separator, and the fuel train inlet is connected to the vapor separator.

10. The device of claim 9, wherein the fuel train further comprises an anti-backfire tank.

11. The device of claim 3 further comprising a hydrox fuel train that is associated with the burner fuel nozzle and has an inlet to receive hydrox fuel.

12. The device of claim 11 further comprising a burner management system associated with the fuel train, the burner fuel nozzle, a pilot fuel nozzle of the burner, a spark ignition system of the burner, and a flame detector of the burner.

13. The device of claim 11, wherein the burner has one or more additional burner fuel nozzles, and the de-superheat nozzle is positioned to spray water downstream of the burner fuel nozzles.

14. The device of claim 13, wherein the fuel train further comprises a vapor separator, and the inlet is connected to the vapor separator.

15. The device of claim 14, wherein the fuel train further comprises an anti-backfire tank.

16. The device of claim 15, wherein the steam from combustion in the fire tube does not mix with process steam.

* * * * *